US008517702B2

(12) United States Patent
Byun et al.

(10) Patent No.: US 8,517,702 B2
(45) Date of Patent: Aug. 27, 2013

(54) ROTARY COMPRESSOR WITH ENHANCED SEALING BETWEEN MODE SWITCHING DEVICE AND CHAMBER THEREOF

(75) Inventors: Sang-Myung Byun, Changwon (KR); Sang-Mo Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 236 days.

(21) Appl. No.: 13/056,398

(22) PCT Filed: Jul. 30, 2009

(86) PCT No.: PCT/KR2009/004258

§ 371 (c)(1),
(2), (4) Date: Jan. 28, 2011

(87) PCT Pub. No.: WO2010/016685

PCT Pub. Date: Feb. 11, 2010

(65) Prior Publication Data

US 2011/0176949 A1 Jul. 21, 2011

(30) Foreign Application Priority Data

Aug. 5, 2008 (KR) ..... 10-2008-0076688

(51) Int. Cl.
*F03C 2/00* (2006.01)
*F03C 4/00* (2006.01)
*F04C 11/00* (2006.01)

(52) U.S. Cl.
USPC ..... 418/11; 418/23; 418/60; 418/63; 418/270; 417/213; 417/440; 285/50; 285/55

(58) Field of Classification Search
USPC ..... 418/11, 23, 26, 60, 63, 270, DIG. 1; 417/213, 216, 218, 286, 410.3, 440, 902; 285/50, 55, 374, 382, 382.4, 382.7
See application file for complete search history.

(56) References Cited

U.S. PATENT DOCUMENTS

| | | | | |
|---|---|---|---|---|
| 4,064,619 | A * | 12/1977 | Echols et al. | 285/374 |
| 4,240,774 | A * | 12/1980 | Ladusaw | 418/248 |
| 6,257,846 | B1 * | 7/2001 | Muramatsu et al. | 417/410.3 |
| 7,435,063 | B2 * | 10/2008 | Tadano et al. | 417/902 |
| 2007/0154329 | A1 | 7/2007 | Onoda | |
| 2007/0243079 | A1 | 10/2007 | Lee et al. | |

FOREIGN PATENT DOCUMENTS

| | | | | |
|---|---|---|---|---|
| CN | 1380947 | | 11/2002 | |
| CN | 101054977 | | 10/2007 | |
| JP | 11-182434 | | 7/1999 | |
| WO | WO 2006090979 | A1 * | 8/2006 | 418/11 |
| WO | WO 2008/023962 | | 2/2008 | |
| WO | WO 2008078946 | A1 * | 7/2008 | 418/11 |

OTHER PUBLICATIONS

International Search Report issued in PCT Application No. PCT/KR2009/004258 dated Sep. 14, 2010.
Chinese Office Action dated Mar. 4, 2013.

* cited by examiner

*Primary Examiner* — Theresa Trieu
(74) *Attorney, Agent, or Firm* — KED & Associates LLP

(57) ABSTRACT

A rotary compressor is provided, in which an inner diameter of a connection hole connected to a vane chamber and an outer diameter of a connection tube inserted into the connection hole are designated so that the connection tube can closely be adhered to the connection hole, thereby preventing a refrigerant from being leaked out between the connection hole and the connection tube so as to allow a fast and accurate mode switching of the vane, resulting in improvement of the performance of the compressor and prevention of noise caused by vibration of the vane.

15 Claims, 8 Drawing Sheets

ROTARY COMPRESSOR WITH ENHANCED SEALING BETWEEN MODE SWITCHING DEVICE AND CHAMBER THEREOF

TECHNICAL FIELD

The present invention relates to a rotary compressor, and more particularly, a rotary compressor capable of enhancing a sealing force between a mode switching unit for switching an operation mode of the compressor and a chamber.

BACKGROUND ART

In general, a refrigerant compressor is applied to a vapor compression type refrigerating cycle (hereinafter, referred to as 'refrigerating cycle'), such as a refrigerator or an air conditioner. A constant-speed type compressor driven at constant speed and an inverter type compressor capable of controlling rotation speed have been introduced as the refrigerant compressor.

The refrigerant compressors are categorized as follows. A refrigerant compressor, in which a driving motor (typically, an electric motor) and a compression part operated by the driving motor are all installed in an inner space of a hermetic casing, is referred to as a hermetic type compressor, and a compressor of which the driving motor is separately installed outside the casing is referred to as an open type compressor. Home or commercial cooling apparatuses usually employ the hermetic type compressor. The refrigerant compressors may be categorized into a reciprocating type, a scroll type, a rotary type and the like according to a refrigerant compression mechanism.

The rotary compressor compresses a refrigerant by use of a rolling piston eccentrically rotating in a compression space of a cylinder and a vane contacted with a rolling piston for partitioning the compression space of the cylinder into a suction chamber and a discharge chamber. In recent time, a variable capacity type rotary compressor capable of varying a cooling capacity of the compressor according to the change in a load has been introduced. Well-known technologies for varying the cooling capacity of the compressor include applying an inverter motor, and varying a volume of a compression chamber by bypassing part of a compressed refrigerant out of a cylinder. However, for employing the inverter motor, a driver for driving the inerter motor is about 10 times as expensive as a driver of a constant-speed motor, thereby rising a fabrication cost of the compressor. On the other hand, for bypassing the refrigerant, a piping system becomes complicated and accordingly a flow resistance of the refrigerant is increased, thereby lowering efficiency of the compressor.

Considering such drawbacks, a so-called modulation type variable capacity rotary compressor, in which at least one or more cylinders are provided and at least one of them is allowed for idling, has been introduced. The modulation type variable capacity rotary compressors may be categorized into a compressor employing a forward pressure mechanism and a compressor employing a recoil pressure mechanism according to a vane restriction method. For instance, the compressor employing the forward pressure mechanism is configured such that a discharge pressure is applied via a suction hole and accordingly a vane is pushed backwardly by pressure of a compression space so as to be restricted, while the compressor employing the recoil pressure mechanism is configured such that a back pressure of suction pressure or discharge pressure is applied to a rear side of the vane so as to selectively restrict the vane. The present invention is applied to a modulation type variable capacity rotary compressor (hereinafter, referred to as 'rotary compressor') employing the recoil pressure mechanism.

The related art rotary compressor uses a connection tube between a connection pipe of a mode switching unit and a rear side of a vane when coupling the mode switching unit in order to apply a back pressure to the rear side of the vane. However, if a diameter of the connection tube and a diameter of a hole in which the connection tube is inserted are not appropriately designated, a leakage of refrigerant may occur. For example, if a great gap exists between the connection tube and the hole, a refrigerant may be leaked through the gap. On the other hand, if the connection tube and the hole are excessively adhered to each other, upon press-fitting the connection tube, the connection tube having relatively low intensity is scratched or crushed, thereby causing the leakage of refrigerant.

DISCLOSURE

Technical Solution

To solve the problems of the related art rotary compressor, an object of the present invention is to a rotary compressor capable of effectively blocking the leakage of refrigerant by optimizing the gap between the connection tube and the hole in which the connection tube is inserted.

To achieve these and other advantages and in accordance with the purpose of the present invention, as embodied and broadly described herein, there is provided a rotary compressor including, at least one cylinder installed in an inner space of a hermetic container, having a compression space for compressing a refrigerant, and provided with a chamber isolated within the inner space of the hermetic container, a plurality of bearings coupled to both upper and lower sides so as to cover the compression space of the cylinder and the chamber, at least one rolling piston configured to compress the refrigerant by being orbited in the compression space of the cylinder, at least one vane slidably coupled to the cylinder and configured to partition the compression space into a suction chamber and a discharge chamber in cooperation with the rolling piston, at least one thereof being supported by a refrigerant filled in the chamber of the cylinder, and a mode switching unit configured to vary an operation mode of the compressor by selectively supplying a refrigerant of suction pressure or a refrigerant of discharge pressure to the chamber of the cylinder, wherein the cylinder or one bearing is provided with a connection hole configured to communicate the chamber with the mode switching unit, and a connection tube is inserted into the connection hole so as to allow the connection of a connection pipe of the mode switching unit, the connection tube having an outer diameter greater than an inner diameter of the connection hole.

Here, a value A obtained by subtracting the inner diameter of the connection hole from the outer diameter of the connection tube may be approximately in the range of $0.02\ \text{mm} \leqq A \leqq 0.15\ \text{mm}$.

An extending portion having an inner diameter increased an inserted direction of the connection tube may be formed at an edge of an inlet end of the connection hole.

A guiding portion may be formed at the inserted end of the connection tube, and have an outer diameter decreased toward an end thereof.

A ratio B of an inclination angle of the extending portion to an inclination angle of the guiding portion may be in the range of $0.2 \leqq B \leqq 2.5$.

The connection tube may be formed of the same material as the connection pipe connected to the mode switching unit.

The connection tube may have a large diameter portion formed at a side thereof connected to the mode switching unit and a small diameter portion formed at a side thereof inserted into the connection hole of the cylinder.

The connection tube may be formed such that the large diameter portion and the small diameter portion are integrated with each other, or formed by assembling a plurality of tubes having different diameters.

MODE FOR INVENTION

Description will now be given in detail of a rotary compressor in accordance with one embodiment of the present invention, with reference to the accompanying drawings.

Figure 1:
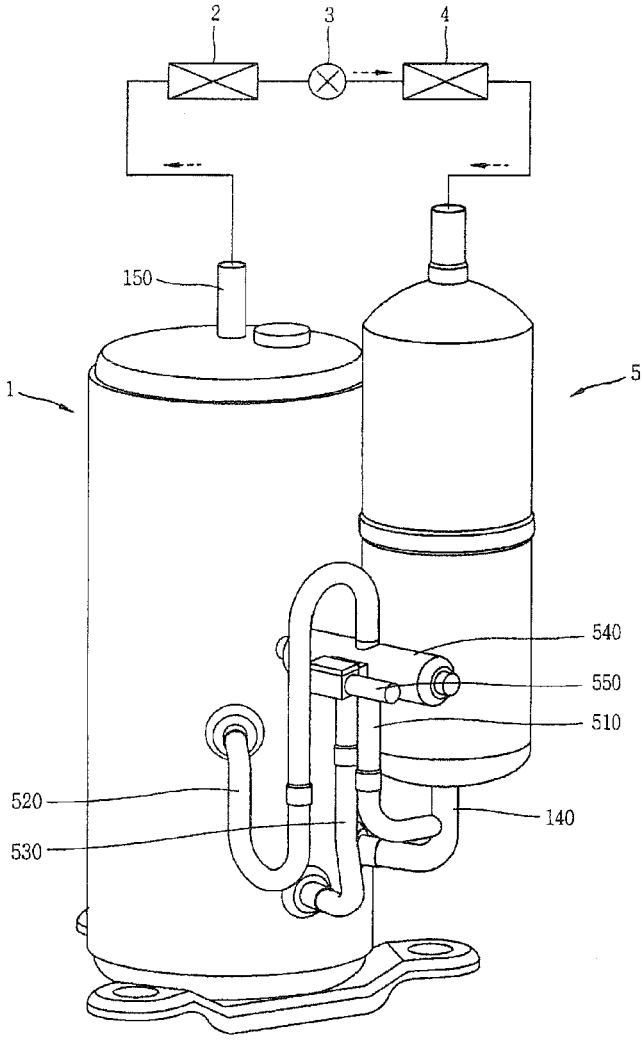
FIG. 1 is a schematic view of a refrigerating cycle including a variable capacity type rotary compressor in accordance with the present invention.

As shown in FIG. 1, a variable capacity type rotary compressor 1 according to the present invention may be configured such that a suction side thereof is connected to an outlet side of an evaporator 4 and simultaneously a discharge side thereof is connected to an inlet side of a condenser 2 so as to form a part of a closed loop refrigerating cycle including the condenser 2, an expansion apparatus 3 and the evaporator 4. An accumulator 5 for separating a refrigerant carried from the evaporator 4 to the compressor 1 into a gaseous refrigerant and a liquid refrigerant may be connected between the discharge side of the evaporator 4 and the inlet side of the compressor 1.

Figure 2:
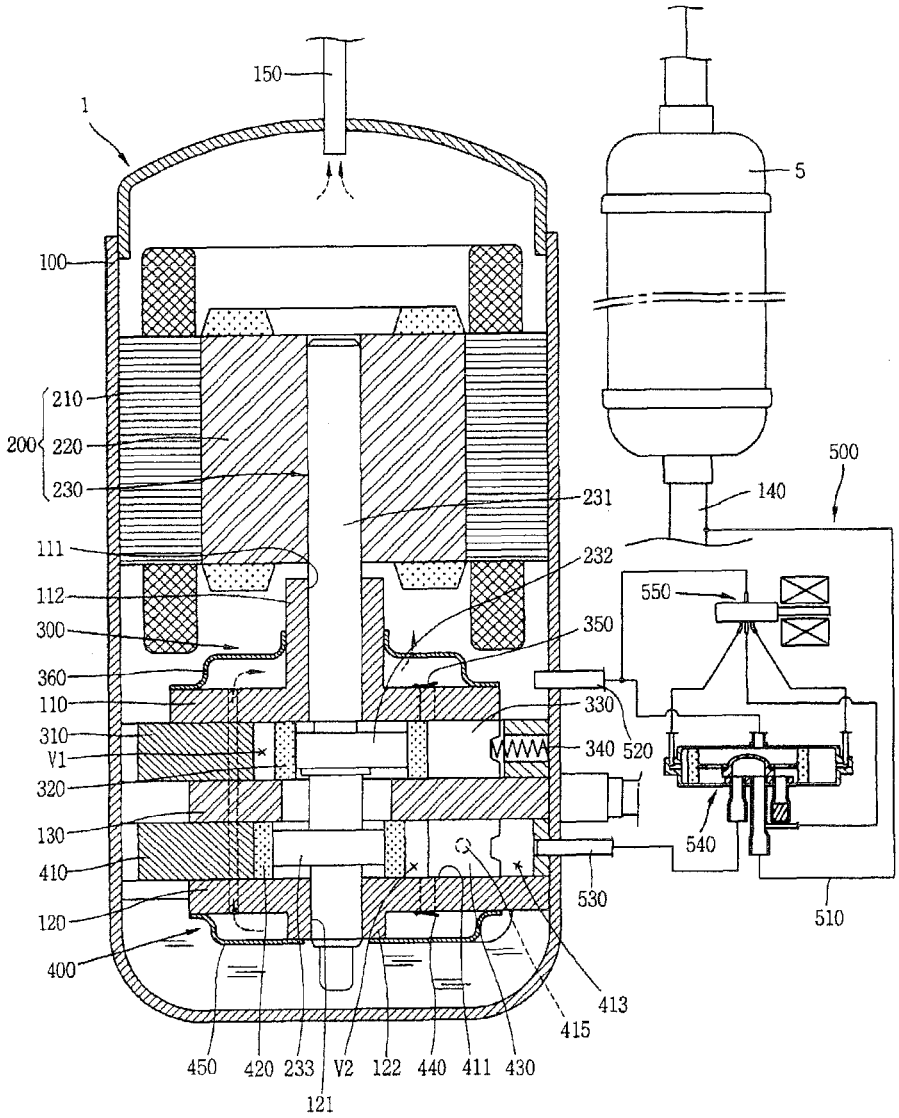
FIG. 2 is a longitudinal cross-sectional view showing an inside of the rotary compressor in accordance with FIG. 1 by being longitudinally cut based upon a vane.

The compressor 1, as shown in FIG. 2, may include a motor part 200 installed at an upper side of an inner space of a hermetic casing 100 for generating a driving force, and first and second compression parts 300 and 400 installed at a lower side of the inner space of the casing 100 for compressing a refrigerant by the driving force generated from the motor part 200. A mode switching unit 500 for switching an operation mode of the compressor 1 such that the second compression part 400 is idled if necessary may be installed outside the casing 100.

The casing 100 may have the inner space maintained in a discharge pressure state by a refrigerant discharged from the first and second compression parts 300 and 400 or from the first compression part 300. One gas suction pipe 140 through which a refrigerant is sucked between the first and second compression parts 300 and 400 may be connected to a circumferential surface of a lower portion of the casing 100. A discharge pipe 150 through which the refrigerant discharged after being compressed in the first and second compression parts 300 and 400 flows into a cooling system may be connected to an upper end of the casing 100.

The motor part 200 may include a stator 210 fixed onto an inner circumferential surface of the casing 100, a rotor 220 rotatably disposed in the stator 210, and a rotation shaft 230 shrink-fitted with the rotor 220 so as to be rotated together with the rotor 220. The motor part 200 may be implemented as a constant-speed motor or an inverter motor. However, an operation mode of the compressor can be switched by idling any one of the first and second compression parts 300 and 400, if necessary, even with employing the constant-speed motor, considering a fabricating cost.

The rotation shaft 230 may include a shaft portion 231 coupled to the rotor 220, and a first eccentric portion 232 and a second eccentric portion 233 both disposed at a lower end section of the shaft portion 231 to be eccentric to both right and left sides. The first eccentric portion 232 and the second eccentric portion 233 may be symmetric to each other with a phase difference of about 180.degree, and rotatably coupled respectively to a first rolling piston 320 and a second rolling piston 420, which will be explained later.

The first compression part 300 may include a first cylinder 310 formed in an annular shape and installed inside the casing 100, a first rolling piston 320 rotatably coupled to the first eccentric portion 232 of the rotation shaft 230 and configured to compress a refrigerant by being orbited in a first compression space V1 of the first cylinder 310, a first vane 330 movably coupled to the first cylinder 310 in a radial direction, with a sealing surface of its one side being contacted with an outer circumferential surface of the first rolling piston 320, and configured to partition the first compression space V1 of the first cylinder 310 into a first suction chamber and a first discharge chamber, and a vane spring 340 configured as a compression spring for elastically supporting a rear side of the first vane 330. Unexplained reference numeral 350 denotes a first discharge valve, and 360 denotes a first muffler.

The second compression part 400 may include a second cylinder 410 formed in an annular shape and installed below the first cylinder 310 inside the casing 100, a second rolling piston 420 rotatably coupled to the second eccentric portion 233 of the rotation shaft 230 and configured to compress a refrigerant by being orbited in a second compression space V2 of the second cylinder 410, and a second vane 430 movable coupled to the second cylinder 410 in a radial direction, and contacted with an outer circumferential surface of the second rolling piston 420 so as to partition the second compression space V2 of the second cylinder 410 into a second suction chamber and a second discharge chamber or spaced from the outer circumferential surface of the second rolling piston 420 so as to communicate the second suction chamber with the second discharge chamber. Unexplained reference numeral 440 denotes a second discharge valve, and 450 denotes a second muffler.

Here, an upper bearing plate 110 (hereinafter, referred to as 'upper bearing') covers the upper side of the first cylinder 310, and a lower bearing plate 120 (hereinafter, referred to as 'lower bearing') covers the lower side of the second cylinder 410. Also, an intermediate bearing plate (hereinafter, referred to as 'intermediate bearing') 130 is interposed between the lower side of the first cylinder 310 and the upper side of the second cylinder 410 so as to support the rotation shaft 230 in a shaft direction with forming the first compression space V1 and the second compression space V2.

Figure 3:
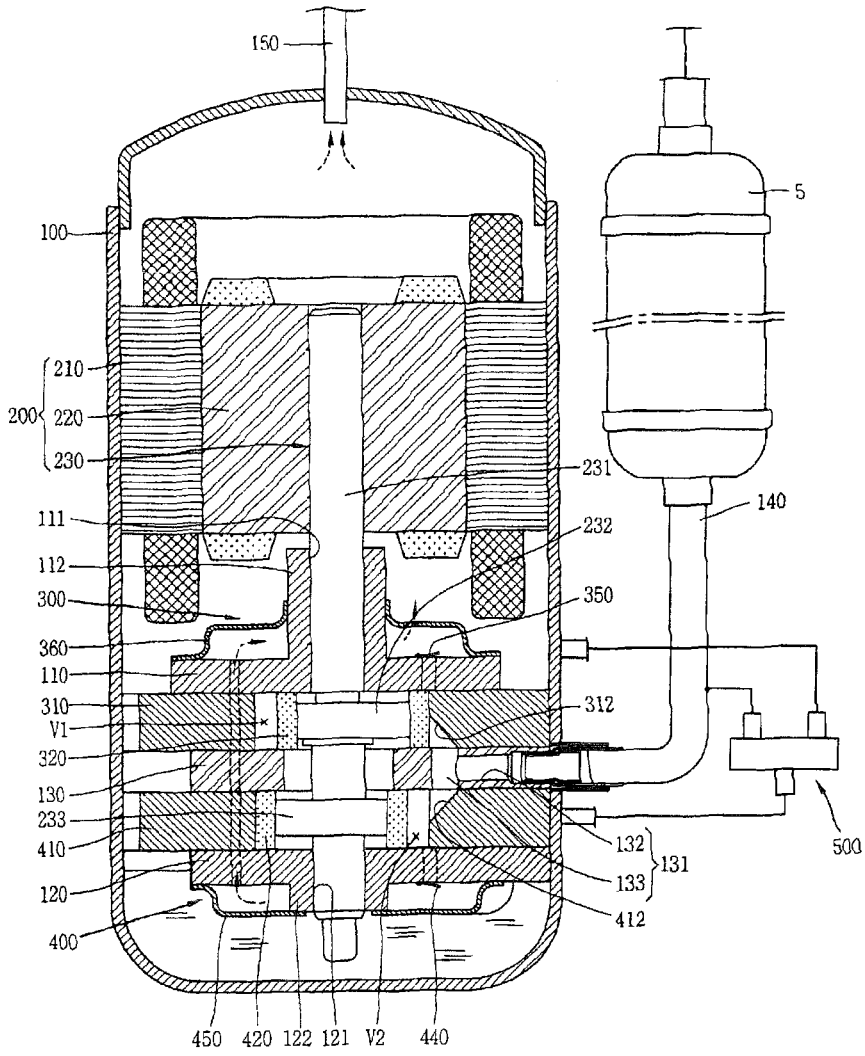
FIG. 3 is a longitudinal cross-sectional view showing an inside of the rotary compressor in accordance with FIG. 1, by being longitudinally cut based upon a suction hole.
Figure 4:
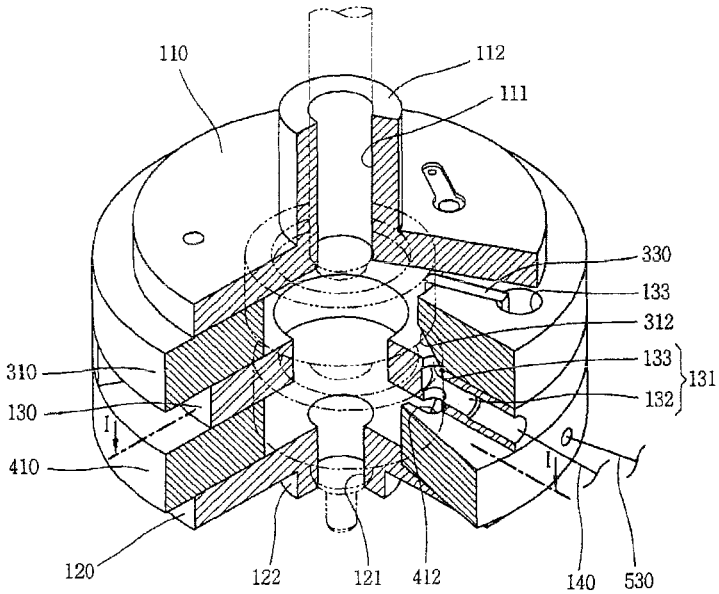
FIG. 4 is a perspective view showing a broken compression part of the rotary compressor in accordance with FIG. 1.

As shown in FIGS. 3 and 4, the upper bearing 110 and the lower bearing 120 are formed in a disc shape, and shaft supporting portions 112 and 122 having shaft holes 111 and 121 for supporting the shaft portion 231 of the rotation shaft 230 in a radial direction may protrude from respective centers thereof. The intermediate bearing 130 is formed in an annular shape with an inner diameter large enough to allow the eccentric portions of the rotation shaft 230 to be penetrated therethrough. A communication passage 131 through which a first suction hole 312 and a second suction hole 412 to be explained later can be communicated with the gas suction pipe 140 may be formed at one side of the intermediate bearing 130.

The communication passage 131 of the intermediate bearing 130 may be provided with a horizontal path 132 formed in a radial direction to be communicated with the gas suction pipe 140, and a longitudinal path 133 formed at an end of the horizontal path 132 and formed through in a shaft direction for communicating the first suction hole 312 and the second suction hole 412 with the horizontal path 132. The horizontal path 132 may be recessed by a prescribed depth from an outer circumferential surface of the intermediate bearing 130 toward an inner circumferential surface thereof, namely, by a depth not completely enough to be communicated with the inner circumferential surface of the intermediate bearing 130.

The first cylinder 310 may be provided with a first vane slot 311 formed at one side of its inner circumferential surface forming the first compression space V1 for allowing the first vane 330 to be linearly reciprocated, a first suction hole 312 formed at one side of the first vane slot 311 for inducing a refrigerant into the first compression space V1, and a first discharge guiding groove (not shown) formed at another side of the first vane slot 311 by chamfering an edge at an opposite side of the first suction hole 312 with an inclination angle, so as to guide a refrigerant to be discharged into an inner space of the first muffler 360.

The second cylinder 410 may be provided with a second vane slot 411 formed at one side of its inner circumferential surface forming the second compression space V2 for allowing the second vane 430 to be linearly reciprocated, a second suction hole 412 formed at one side of the second vane slot 411 for inducing a refrigerant into the second compression space V2, and a second discharge guiding groove (not shown) formed at another side of the second vane slot 411 by chamfering an edge at an opposite side of the second suction hole 412 with an inclination angle so as to guide a refrigerant to be discharged into an inner space of the second muffler 450.

The first suction hole 312 may be formed with an inclination angle by chamfering an edge of a lower surface of the first cylinder 310, contacted with an upper end of the longitudinal path 133 of the intermediate bearing 130, toward the inner circumferential surface of the first cylinder 310.

The second suction hole 412 may be formed with an inclination angle by chamfering an edge of an upper surface of the second cylinder 410, contacted with a lower end of the longitudinal path 133 of the intermediate bearing 130, toward the inner circumferential surface of the second cylinder 410.

Here, the second vane slot 411 may be formed by cutting (recessing) the second cylinder 410 into a preset depth in a radial direction such that the second vane 430 can be linearly reciprocated. A vane chamber 413 may be formed at a rear side of the second vane slot 411, namely, at a portion on an outer circumferential surface of the second cylinder 410, so as to be communicated with a common connection pipe 530 to be explained later.

The vane chamber 413 may be hermetically coupled by the intermediate bearing 130 and the lower bearing 120 contacting with its upper and lower surfaces so as to be isolated within the inner space of the casing 100. The vane chamber 413 may have a preset inner volume such that the rear surface of the second vane 430 can serve as a pressed surface by a refrigerant supplied via the common connection pipe 530 even if the second vane 430 is completely retracted to be accommodated within the second vane slot 411.

Figure 5:
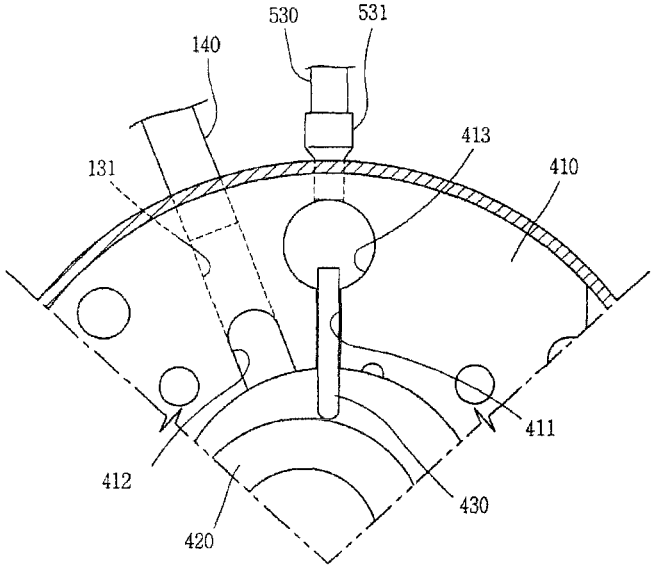
FIG. 5 is a horizontal cross-sectional view showing a connection hole and a connection tube for connecting a common connection pipe in the rotary compressor in accordance with FIG. 1.
Figure 6:
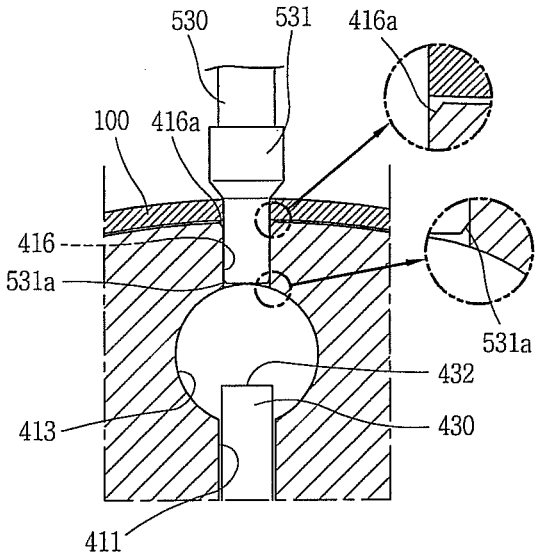
FIG. 6 is an enlarged horizontal cross-sectional view showing an assembled state between the connection hole and the connection tube in the rotary compressor in accordance with FIG. 5.
Figure 7:
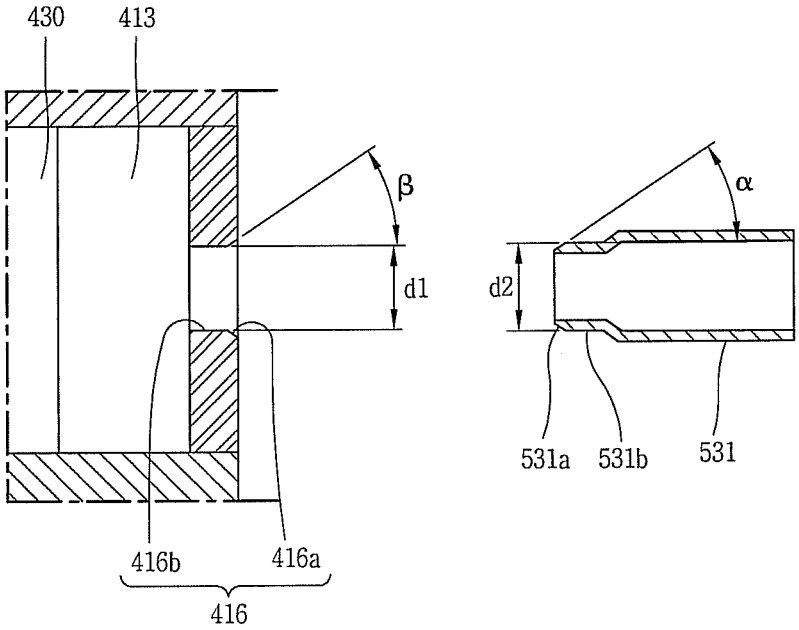
FIG. 7 is an enlarged longitudinal cross-sectional view showing a relation between the connection hole and the connection tube in accordance with FIG. 6.

As shown in FIGS. 5 to 7, a connection hole 416 communicated with a common connection pipe 530 to be explained later may be formed at one side of the vane chamber 413, namely, at a center of the second cylinder 410 to extend toward an outer circumferential surface of the second cylinder 410. A connection tube 531 for connecting the vane chamber 413 to the common connection pipe 530 may be inserted into the connection hole 416 for coupling.

The connection hole 416 may be formed in a right circular shape, and provided with an extending portion 416*a* formed at an outer edge thereof, namely, at an edge of a side in which the connection tube 531 is inserted. The extending portion 416*a* may have a diameter increased toward the outside of the connection hole 416 so as to facilitate the insertion of the connection tube 531. The extending portion 416*a* may be inclined as shown in the drawings; however, in some cases, it may be curved.

The connection tube 531 may preferably be formed of the same material to the common connection pipe 530 because it is welded with the common connection pipe 530. Also, the connection tube 531 may be formed to have a large diameter portion at the side being connected to the common connection pipe 530 and a small diameter portion at the side being inserted into the connection hole 416 of the second cylinder 410. The connection tube 531 may have the large diameter portion and the small diameter portion integrally formed with each other; however, a plurality of tubes having different diameters may be assembled to form the connection tube 531. The connection tube 531 may be provided with a guiding portion 531*a* formed at an end thereof, namely, an end inserted into the connection hole 416, and having an outer diameter getting narrower in its inserted direction. The guiding portion 531*a* may be formed to be inclined as shown in the drawing; but, in some cases, it may be formed to be curved. Here, the guiding portion 531*a* of the connection tube 531 may be formed such that a ratio B obtained by dividing an inclination angle .alpha. by inclination angle .beta. of the extending portion of the connection hole is approximately in the range of 0.2 to 2.5, which allows a smooth press-fitting of the connection tube 531.

An inner circumferential surface of the connection hole 416 and an outer circumferential surface of the connection tube 531 may be closely adhered to each other so as to minimize the leakage of the refrigerant from the vane chamber 413. However, if an outer diameter d2 (i.e., an outer diameter of the small diameter portion) of the connection tube 531 is excessively greater than an inner diameter d1 of the connection tube 531, the connection tube 531 may be scratched or crushed upon being press-fitted, accordingly the connection hole 416 and the connection tube 531 may be formed with appropriate sizes so as to be closely adhered with each other without deformation.

To this end, preferably, a gap A between the connection hole 416 and the connection tube 531, namely, the differential value obtained by subtracting the inner diameter d1 of the connection hole 416 from the outer diameter d2 of the connection tube 531 may be approximately in the range of 0.02 mm to 0.15 mm.

Figure 8:
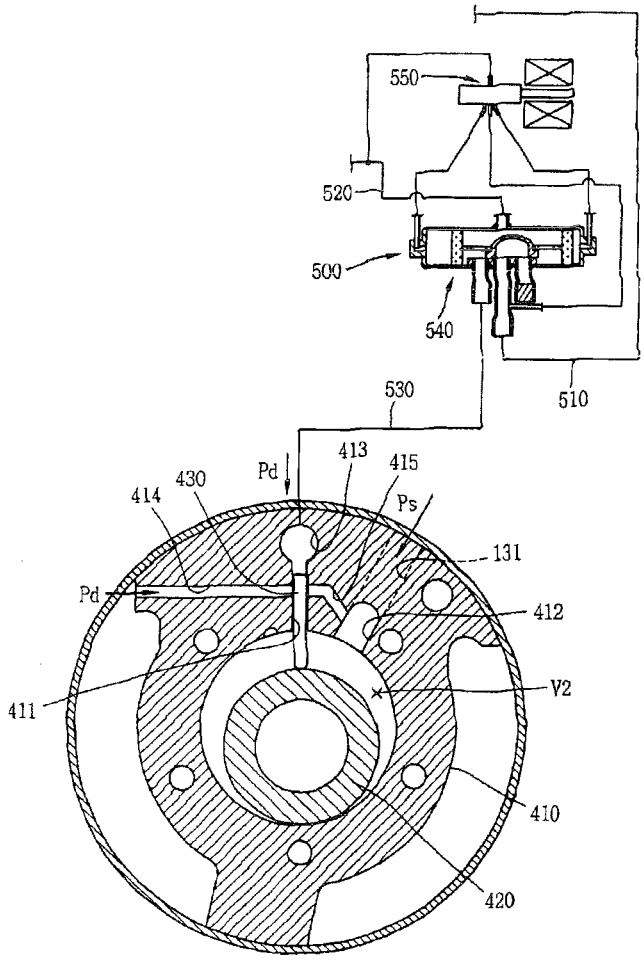
FIG. 8 is a view showing restricting passages for restricting a second vane in the rotary compressor in accordance with FIG. 1, which is a view taken along the line I-I of FIG. 4.

The pressed surface 432 of the second vane 430 is supported by a refrigerant of a suction pressure or a refrigerant of a discharge pressure filled in the vane chamber 413 such that a sealing surface 431 thereof comes in contact with or is spaced from the second rolling piston 420 according to an operation mode of the compressor. Accordingly, in order to prevent beforehand compressor noise or efficiency degradation due to the vibration of the second vane 430, the second vane 430 should be restricted within the second vane slot 411 in a particular operation mode of the compressor, i.e., in a saving mode. To this end, a restriction method for the second vane using internal pressure of the casing 100, as shown in FIG. 8, may be proposed.

For example, the second cylinder 410 may be provided with a high pressure side vane restricting passage (hereinafter, referred to as 'first restricting passage') 414 orthogonal to a motion direction of the second vane 430 or formed in a direction at least having a stagger angle with respect to the second vane 430. The first restricting passage 414 allows the inside of the casing 100 to be communicated with the second vane slot 411 such that a refrigerant of discharge pressure filled in the inner space of the casing 100 pushes the second vane 430 towards an opposite vane slot surface, thereby restricting the second vane 430. A lower pressure side vane restricting passage (hereinafter, referred to as 'second restricting passage') for allowing the second vane slot 411 to be communicated with the second suction hole 412 may be formed at an opposite side of the first restricting passage 414. The second restricting passage 415 generates a pressure difference from the first restricting passage 414 such that a refrigerant of discharge pressure introduced via the first restricting passage 414 flows through the second restricting passage 415, thereby quickly restricting the second vane 430.

The mode switching unit 500, as shown in FIGS. 1 and 2, may include a low pressure side connection pipe 510 having one end diverged from the gas suction pipe 140, a high pressure side connection pipe 520 having one end connected to the inner space of the casing 100, a common connection pipe 530 having one end connected to the vane chamber 413 of the second cylinder 410 so as to be selectively communicated with the low pressure side connection pipe 510 and the high pressure side connection pipe 520, a first mode switching valve 540 connected to the vane chamber 413 of the second cylinder 410 via the common connection pipe 530, and a second mode switching valve 550 connected to the first mode switching valve 540 for controlling the switching operation of the first switching valve 540.

A basic compression process of the variable capacity type rotary compressor according to the present invention will be described hereinafter.

That is, when power is applied to the stator 210 of the motor part 200 and the rotor 220 is rotated accordingly, the rotation shaft 230 is rotated together with the rotor 220 so as to transfer the rotational force of the motor part 200 to the first compression part 300 and the second compression part 400. Within the first and second compression parts 300 and 400, the first rolling piston 320 and the second rolling piston 420 are eccentrically rotated respectively in the first compression space V1 and the second compression space V2, and the first vane 330 and the second vane 430 compress a refrigerant with forming the respective compression spaces V1 and V2 with a phase difference of 180° therebetween in cooperation with the first and second rolling piston 320 and 420.

For example, upon initiating a suction process in the first compression space V1, a refrigerant is introduced into the communication passage 131 of the intermediate bearing 130 via the accumulator 5 and the suction pipe 140. Such refrigerant is sucked into the first compression space V1 via the first suction hole 312 of the first cylinder 310 to be then compressed therein. During the compression process within the first compression space V1, a suction process is initiated in the second compression space V2 of the second cylinder with the phase difference of 180° with the first compression space V1. Here, the second suction hole 412 of the second cylinder 410 is communicated with the communication passage 131 such that the refrigerant is sucked into the second compression space V2 via the second suction hole 412 of the second cylinder 410 to be then compressed therein.

In the meantime, a process of varying the capacity of the variable capacity type rotary compressor will be described hereinafter.

Figure 9:
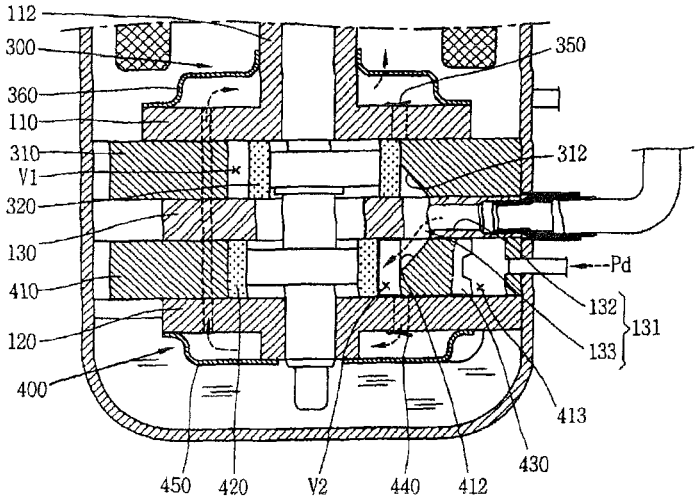
FIGS. 9 and 10 are longitudinal and horizontal cross-sectional views showing a power mode of the rotary compressor in accordance with FIG. 1.
Figure 10:
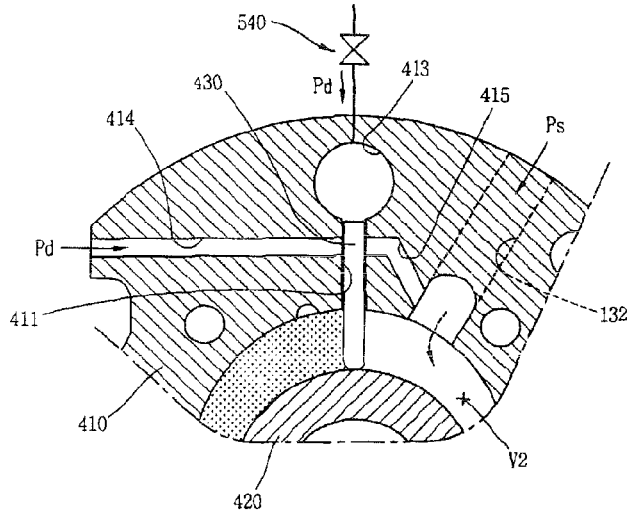

That is, even in case where the compressor or an air conditioner having the same is operated in a power mode, as shown in FIGS. 9 and 10, power is applied to the first mode switching valve 540, accordingly, the low pressure type connection pipe 510 is blocked while the high pressure type connection pipe 520 is connected to the common connection pipe 530. Accordingly, a high pressure gas within the casing 100 is supplied into the vane chamber 413 of the second cylinder 410 via the high pressure side connection pipe 520. The second vane 430 is then pushed by the high pressure refrigerant filled in the vane chamber 413 to be maintained in a state of being press-contacted with the second rolling piston 420. Hence, the refrigerant gas introduced into the second compression space V2 is normally compressed and discharged.

Here, the high pressure refrigerant gas or oil is applied via the first restricting passage 414 disposed in the second cylinder 410 so as to press one side surface of the second vane 430. However, as the sectional area of the first restricting passage 414 is narrower than that of the second vane slot 411, the pressure applied to the side surface of the second vane 430 is lower than the pressure applied thereto in back and forth directions within the vane chamber 413, accordingly the second vane 430 is not restricted. Therefore, the second vane 430 partitions the second compression space V2 into a suction chamber and a discharge chamber by being press-contacted with the second rolling piston 420, such that the entire refrigerant sucked into the second compression space V2 is compressed and discharged. Accordingly, the compressor or the air conditioner having the same can be operated with 100% of capacity.

Figure 11:
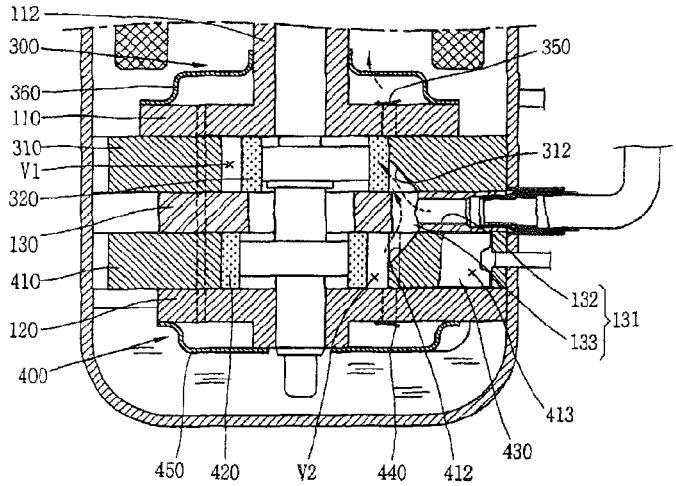
FIGS. 11 and 12 are longitudinal and horizontal cross-sectional views showing a saving mode of the rotary compressor in accordance with FIG. 1.
Figure 12:
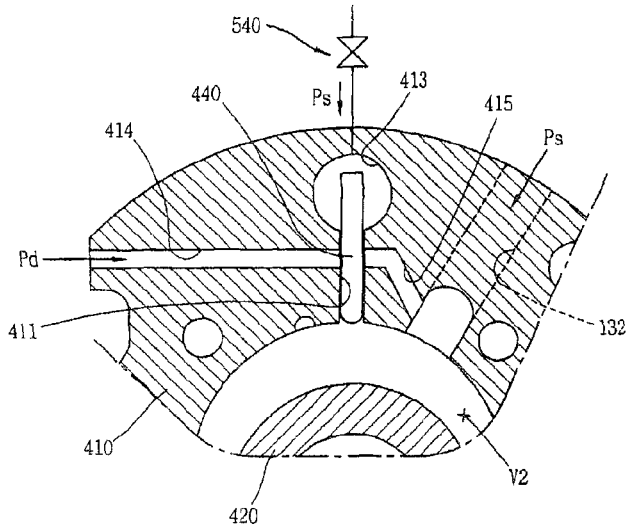

On the other hand, in a saving mode, such as upon initiating the compressor or the air conditioner having the same, as shown in FIGS. 11 and 12, power is not supplied to the first mode switching valve 540. Accordingly, contrary to the power mode, the low pressure side connection pipe 510 is communicated with the common connection pipe 530 and a lower pressure refrigerant (gas) sucked into the second cylinder 410 is partially introduced into the vane chamber 413. Consequently, the second vane 430 is pushed by the refrigerant compressed in the second compression space V2 so as to be accommodated within the second vane slot 411. The suction chamber and the discharge chamber of the second compression space V2 are accordingly communicated with each other, and thereby the refrigerant gas sucked into the second compression space V2 cannot be compressed.

Here, a great pressure difference occurs between the pressure applied to one side surface of the second vane 430 by the first restricting passage 414 disposed in the second cylinder 410 and the pressure applied to another side surface of the second vane 430 by the second restricting passage 415. Accordingly, the pressure applied via the first restricting passage 414 shows a tendency to move toward the second restricting passage 415, thereby rapidly restricting the second vane 430 without vibration. In addition, at the time when the pressure of the vane chamber 413 is converted from discharge pressure into suction pressure, the discharge pressure remains in the vane chamber 413 so as to form a type of intermediate pressure Pm. However, the intermediate pressure Pm of the vane chamber 413 is leaked via the second restricting passage 415 with pressure lower than that. Accordingly, the pressure of the vane chamber 413 is fast converted into the suction pressure Ps, resulting in much quickly preventing the vibration of the second vane 430. Hence, the second vane 430 can be restricted fast and effectively. Therefore, as the second compression space of the second cylinder 410 is communicated into one space, the entire refrigerant sucked into the second compression space V2 of the second cylinder 410 is not compressed but flows along the track of the second rolling piston. Part of the refrigerant is moved into the first compression space V1 via the communication passage 131 and the first suction hole 312 due to the pressure difference, so the second compression part 400 is not operated. Consequently, the compressor or the air conditioner having the same is operated only with the capacity of the first compression part. Also, during this process, the refrigerant within the second compression space V2 flows into the first compression space V1 without flowing back into the accumulator 5, thereby preventing the overheat of the accumulator 5, resulting in the reduction of suction loss.

Figure 13:
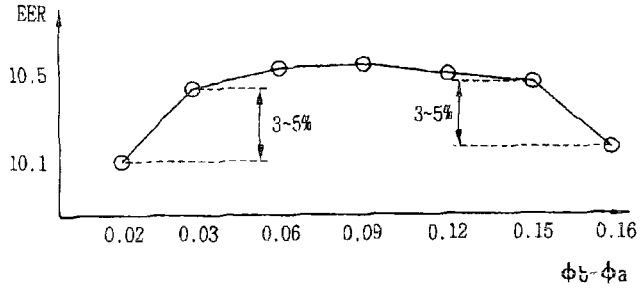
FIG. 13 is a graph showing the changes in the performance of the compressor according to the changes in a value obtained by subtracting an inner diameter of a connection hole from an outer diameter of a connection tube in a rotary compressor in accordance with the present invention.

Here, in order to connect the common connection pipe 530 to the vane chamber 413 of the second cylinder 410, the connection tube 531 is press-fitted into the connection hole 530 and then the common connection pipe 530 is inserted into the connection tube 531 to be then welded together. However, as shown in FIG. 7, the outer diameter d2 of the connection tube 531 is formed with an appropriate size with respect to the inner diameter d1 of the connection hole 416. Hence, when press-fitting the connection tube 531 into the connection hole 416, the connection tube 531 can be closely adhered to the connection hole 416 without scratch or deformation, which prevents beforehand a refrigerant sucked into the vane chamber 413 from being leaked out between the connection hole 416 and the connection tube 531, resulting in improvement of the performance of the rotary compressor. FIG. 13 is a graph showing the changes in the performance of the compressor depending on the change in a value obtained by subtracting the inner diameter d1 of the connection hole 416 from the outer diameter d2 of the connection tube 531 as shown in the embodiment of the present invention. Referring to this, it can be seen that the performance of the compressor is improved 3~5% when the d2−d1 value is in the range of 0.02 to 0.15.

In the meantime, although not shown in the drawing, the connection hole may be formed at the first cylinder other than the second cylinder or at the lower bearing, the intermediate bearing or the upper bearing, and may be equally formed even in this case to that in the aforesaid embodiment.

INDUSTRIAL AVAILABILITY

The embodiment of the present invention is applied to a double type rotary compressor; but may be applicable to a single type rotary compressor having a vane chamber. Also, the rotary compressor in accordance with the present invention may be widely applied to cooling apparatuses employing a refrigerant compression type refrigerating cycle, such as air conditioners.

The invention claimed is:

1. A rotary compressor, comprising:

at least one cylinder installed in an inner space of a hermetic container, having a compression space to compress a refrigerant, and having a chamber isolated within the inner space of the hermetic container;

a plurality of bearings coupled to both upper and lower sides of the at least one cylinder that covers the compression space of the at least one cylinder and the chamber;

at least one rolling piston configured to compress the refrigerant by being orbited in the compression space of the at least one cylinder;

at least one vane slidably coupled to the at least one cylinder and configured to partition the compression space into a suction chamber and a discharge chamber in cooperation with the rolling piston, at least one thereof being supported by a refrigerant filled in the chamber of the at least one cylinder; and a mode switching device configured to vary an operation mode of the compressor by selectively supplying a refrigerant of suction pressure or a refrigerant of discharge pressure to the chamber of the at least one cylinder, wherein the at least one cylinder or one of the plurality of bearings includes a connection hole configured to communicate the chamber with the mode switching device, wherein a connection tube is inserted into a uniform-diameter portion of the connection hole so as to allow the connection of a connection pipe of the mode switching device, wherein a uniform-diameter portion of the connection tube has an outer diameter greater than an inner diameter of the uniform-diameter portion of the connection hole, wherein an extending portion having an inner diameter increased in an insertion direction of the connection tube is formed at an edge of an inlet end of the uniform-diameter portion of the connection hole, wherein a guiding portion is formed at an outer edge of the inserted end of the connection tube, and wherein the guiding portion has an outer diameter decreased toward an end thereof.

2. The compressor of claim 1, wherein a value A obtained by subtracting the inner diameter of the connection hole from the outer diameter of the connection tube is approximately in a range of 0.02 mm≦A≦0.15 mm.

3. The compressor of claim 1, wherein a ratio B of an inclination angle of the extending portion to an inclination angle of the guiding portion is in a range of 0.25≦B≦2.5.

4. The compressor of claim 1, wherein the connection tube is formed of the same material as the connection pipe connected to the mode switching device.

5. The compressor of claim 1, wherein the connection tube has a large diameter portion formed at a side thereof connected to the mode switching device and a small diameter portion formed at a side thereof inserted into the connection hole of the at least one cylinder, and wherein the small diameter portion has a uniform inner diameter.

6. The compressor of claim 5, wherein the connection tube is formed such that the large diameter portion and the small diameter portion are integrated with each other.

7. The compressor of claim 5, wherein the connection tube is formed by assembling a plurality of tubes having different diameters.

8. The compressor of claim 1, wherein the connection tube is press fitted into the connection hole.

9. A rotary compressor, comprising:

at least one cylinder installed in an inner space of a hermetic container, having a compression space to compress a refrigerant, and having a chamber isolated within the inner space of the hermetic container;

a plurality of bearings coupled to both upper and lower sides of the at least one cylinder that covers the compression space of the at least one cylinder and the chamber;

at least one rolling piston configured to compress the refrigerant by being orbited in the compression space of the at least one cylinder;

at least one vane slidably coupled to the at least one cylinder and configured to partition the compression space into a suction chamber and a discharge chamber in cooperation with the rolling piston, at least one thereof being supported by a refrigerant filled in the chamber of the at least one cylinder; and a mode switching device configured to vary an operation mode of the compressor by selectively supplying a refrigerant of suction pressure or a refrigerant of discharge pressure to the chamber of the at least one cylinder, wherein the at least one cylinder or one of the plurality of bearings includes a connection hole configured to communicate the chamber with the mode switching device, wherein a connection tube having a large diameter portion formed at a side thereof is connected to the mode switching device and a small diameter portion formed at the other side thereof is inserted into the connection hole of the at least one cylinder, wherein the small diameter portion has a uniform inner diameter, wherein the connection tube is inserted into the connection hole so as to allow the connection of a connection pipe of the mode switching device, wherein the connection tube has an outer diameter greater than an inner diameter of the connection hole, wherein an extending portion having an inner diameter increased in an inserted direction of the connection tube is formed at an inner edge of an inlet end of the connection hole, wherein a guiding portion is formed at an outer edge of the inserted end of the connection tube, and wherein the guiding portion has an outer diameter decreased toward an end thereof.

10. The compressor of claim 9, wherein a value A obtained by subtracting the inner diameter of the connection hole from the outer diameter of the connection tube is approximately in a range of $0.02\ \text{mm} \leqq A \leqq 0.15\ \text{mm}$.

11. The compressor of claim 9, wherein a ratio B of an inclination angle of the extending portion to an inclination angle of the guiding portion is in a range of $0.2 \leqq B \leqq 2.5$.

12. The compressor of claim 9, wherein the connection tube is formed of the same material as the connection pipe connected to the mode switching device.

13. The compressor of claim 9, wherein the connection tube is formed such that the large diameter portion and the small diameter portion are integrated with each other.

14. The compressor of claim 9, wherein the connection tube is formed by assembling a plurality of tubes having different diameters.

15. The compressor of claim 9, wherein the connection tube is press fitted into the connection hole.

* * * * *